US009574374B2

(12) United States Patent
Klevens et al.

(10) Patent No.: US 9,574,374 B2
(45) Date of Patent: Feb. 21, 2017

(54) RESTROOM STALL OCCUPANCY INDICATOR SYSTEM

(71) Applicant: Tooshlights, LLC, Newbury Park, CA (US)

(72) Inventors: Allen Klevens, Calabasas, CA (US); Todd Bermann, Newbury Park, CA (US); Laura Hazard, Los Angeles, CA (US)

(73) Assignee: Modus Systems, Inc., Calabasas, CA (US)

( * ) Notice: Subject to any disclaimer, the term of this patent is extended or adjusted under 35 U.S.C. 154(b) by 12 days.

(21) Appl. No.: 14/628,177

(22) Filed: Feb. 20, 2015

(65) Prior Publication Data

US 2015/0233146 A1 Aug. 20, 2015

Related U.S. Application Data

(60) Provisional application No. 61/942,456, filed on Feb. 20, 2014.

(51) Int. Cl.

| | |
|---|---|
| ***G08B 21/00*** | (2006.01) |
| ***E05B 41/00*** | (2006.01) |
| ***E05B 65/00*** | (2006.01) |
| *E05B 17/10* | (2006.01) |
| *E05B 47/00* | (2006.01) |

(52) U.S. Cl.

CPC ..... *E05B 41/00* (2013.01); *E05B 65/0035* (2013.01); *E05B 17/10* (2013.01); *E05B 2047/0069* (2013.01); *E05B 2047/0094* (2013.01)

(58) Field of Classification Search

CPC ..... E05B 41/00; E05B 55/00; E05B 17/10; G07C 2209/62

USPC ..... 340/687, 521, 555, 545.1, 691.6, 539.1

See application file for complete search history.

(56) References Cited

U.S. PATENT DOCUMENTS

| | | | | |
|---|---|---|---|---|
| 5,476,221 | A * | 12/1995 | Seymour | F24F 11/0034 236/47 |
| 5,861,806 | A * | 1/1999 | Vories | G08B 5/36 340/545.3 |
| 6,140,921 | A | 10/2000 | Baron et al. | |
| 7,177,725 | B2 | 2/2007 | Nortier et al. | |
| 8,141,296 | B2 | 3/2012 | Bem | |
| 8,284,018 | B2 | 10/2012 | Ibsies | |
| 8,364,546 | B2 | 1/2013 | Yenni et al. | |
| 9,118,220 | B2 * | 8/2015 | Lamb | H02J 13/0086 |

(Continued)

FOREIGN PATENT DOCUMENTS

| | | |
|---|---|---|
| CA | 2627110 A1 | 10/2009 |
| KR | 20020020340 | 3/2002 |
| WO | WO2013151487 | 10/2013 |

*Primary Examiner* — Phung Nguyen

(74) *Attorney, Agent, or Firm* — Lowry Blixseth LLP; Scott M. Lowry

(57) ABSTRACT

The restroom stall occupancy indicator system includes a latch coupled to a stall door and movable between a locked position and an unlocked position. A sensor is responsive to selected positioning of the latch and communications the position information to a transmitter. The transmitter then relays the position information to a receiver coupled to an indicator. The indicator, in turn, is responsive to the received position information to provide a first visual identification when the latch is in the unlocked position and a second visual identification when the latch is in the locked position.

23 Claims, 14 Drawing Sheets

(56) References Cited

U.S. PATENT DOCUMENTS

| | | | | |
|---|---|---|---|---|
| 9,188,220 | B2 * | 11/2015 | Masunaga | F16H 61/686 |
| 2014/0111329 | A1 * | 4/2014 | Tearston | E05B 17/22 340/521 |
| 2014/0329459 | A1 | 11/2014 | Salathe et al. | |

* cited by examiner

RESTROOM STALL OCCUPANCY INDICATOR SYSTEM

BACKGROUND OF THE INVENTION

The present invention generally relates to a restroom stall occupancy indicator system. More specifically, the present invention relates to a restroom stall occupancy indicator system having an externally visible indicator that changes color to reflect the state of stall occupancy communicated by a respective restroom stall latch mechanism.

Stadiums, airports, convention centers, shopping malls, and other large venues may have multiple bathrooms with several or even dozens of bathroom stalls. Arranging stalls in a bathroom in an elongated corridor can make it difficult for patrons, who usually wait near the restroom entrance, to determine which stalls are vacant. In this respect, patrons may look through or under the stall wall doors to try and determine if the stall is occupied. This practice is inefficient and may be uncomfortable and embarrassing for both patrons. As a result, many patrons simply wait near the entrance and watch for someone to exit a stall. But, this is only effective assuming someone leaves a stall. In cases where a stall is empty, unbeknownst to waiting patrons, that stall will remain unoccupied and unused unless someone endeavors to view into the stall, as mentioned above. This practice can increase wait times and generate longer than desired wait times for patrons who desire to use the restroom. Such underutilization of the restroom stalls can result in added patron frustration and reduced enjoyment of the venue. Reduced enjoyment may reduce patronage of the venue and reduce spending. For example, patrons at the venue may engage in other activities such as purchasing concessions, souvenirs, etc. instead of waiting in line to use the bathroom.

There exists, therefore, a significant need in the art for a restroom stall occupancy indicator system that includes an externally viewable indicator that changes color in response to receiving occupancy status information communicated by a stall door signal unit that determines whether the stall latch is locked and the stall being used by a patron. The present invention fulfills these needs and provides further related advantages.

SUMMARY OF THE INVENTION

The restroom stall occupancy indicator system as disclosed herein generally includes a latch attached to a restroom stall door and movable between a locked position and an unlocked position. A sensor coupled with the latch is responsive to selected positioning of the latch in the locked position or in the unlocked position. A transmitter in communication with the sensor relays a communication signal indicating that the latch is in the locked position or in the unlocked position. This communication signal is then received by a remote receiver, and preferably one coupled with an indicator. The indicator, in turn, then responds to the communication signal by providing a first visual identification when the latch is in the unlocked position and a second visual identification when the latch is in the locked position.

In one embodiment, the latch may include a cam movable relative to the sensor, wherein the cam selectively pivots a switch into engagement with the sensor when the latch moves into the locked position, and permits selective pivotal disengagement of the switch from the sensor when the latch moves into the unlocked position. The latch itself may include an externally accessible knob for manual movement between the locked position and the unlocked position from inside the restroom stall. In this respect, the latch may selectively mount to an interior surface of the stall door and the transmitter may selectively mount to an exterior surface of the stall door so that the latch and the transmitter selectively sandwich the stall door therebetween. The latch may be battery powered or may be connected to a hardwire power source. Additionally, the indicator may include multiple indicator lights coupled to one another in a daisy-chain and the latch may include an active portion housing the switch and sensor and an inactive portion configured for slide in reception of the latch to retain a restroom door in the locked position.

The communication signal preferably includes a first occupied signal when the latch is in the locked position and a second unoccupied signal when the latch is in the unlocked position. The communication signal may also be a wireless communication signal or a wired communication signal, such as over an Ethernet communication line. Although, the wireless communication signal is preferably an infrared signal. The signals provided to the indicator may cause the indicator to change colors. In this respect, the communication signal indicating that the latch is in the unlocked position may cause an indicator light to emit a first color (e.g., "green"), while a communication signal indicating that the latch is in the locked position may cause the indicator light to emit a second color (e.g., "red"). The indicator and related light should be mounted in a position readily viewable by a patron, and possibly easily visible down a corridor in a multi-stall restroom. For example, the indicator may selectively mount to a restroom ceiling and include a receiver in remote communication with the latch transmitter or a communication hub.

In another embodiment, the system for providing occupancy status for a multi-stall restroom includes a signal unit associated with each stall in the multi-stall restroom. Each signal unit is preferably movable between a locked position and an unlocked position, depending on stall occupancy. A sensor associated with each signal unit is responsive to selected positioning of the respective signal unit between the locked and unlocked positions. Additionally, each signal unit preferably includes a transmitter in communication with each sensor. The transmitter relays a respective communication signal indicating that the respective signal unit is either in the locked position or in the unlocked position. A remote indicator associated with each signal unit and responsive to the respective communication signal provides a first visual identification when the respective signal unit is in the unlocked position and a second visual identification when the signal unit is in the locked position. A communication hub may provide real-time occupancy data for the multi-stall restroom based on the locked and/or unlocked position of each of the signal units associated with each stall.

Additionally, a receiver may be coupled with each remote indicator for receiving the communication signal from the transmitter. In this respect, the communication hub may include a wireless transmitter and/or a wireless receiver for communication with the signal unit by way of the receiver and/or the remote indicator. In a preferred embodiment, the communication signal is an infrared signal and the remote indicator includes a ceiling mountable bracket for installation remote of the signal unit. The communication hub may include a central server that communicates or otherwise helps provide real-time stall data to a facilities management system. The first visual identification may include a first-colored light and the second visual identification may include a second colored-light.

More specifically, each signal unit may include an externally accessible latch for manual movement between the locked position and the unlocked position. Here, the latch may selectively mount to an interior surface of a stall door and the transmitter may selectively mount to an exterior surface of the stall door, whereby the latch and the transmitter selectively sandwich the stall door therebetween. The signal unit may further include a cam movable relative to the sensor, wherein the cam selectively pivots a switch into engagement with the sensor when the signal unit moves into the locked position, and permits selective pivotal disengagement of the switch from the sensor when the latch moves into the unlocked position.

In another aspect, a method for providing an occupancy status indication for a restroom stall, includes sensing movement of a latch between an unlocked position and a locked position, transmitting a wireless communication signal identifying whether the latch is in the unlocked position or in the locked position, and changing an indicator for providing a first visual identification when the latch is in the unlocked position and a second visual identification when the latch is in the locked position. Additionally, the changing step may include illuminating a light with a first-colored light when the restroom stall is occupied and illuminating the light with a second colored-light when the restroom stall is unoccupied. Preferably, the system communicates real-time occupancy information to a web-accessible server, wherein the real-time occupancy information may include stall availability, an approximate wait time or a maintenance issue accessible by a smartphone or other portable electronic device.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
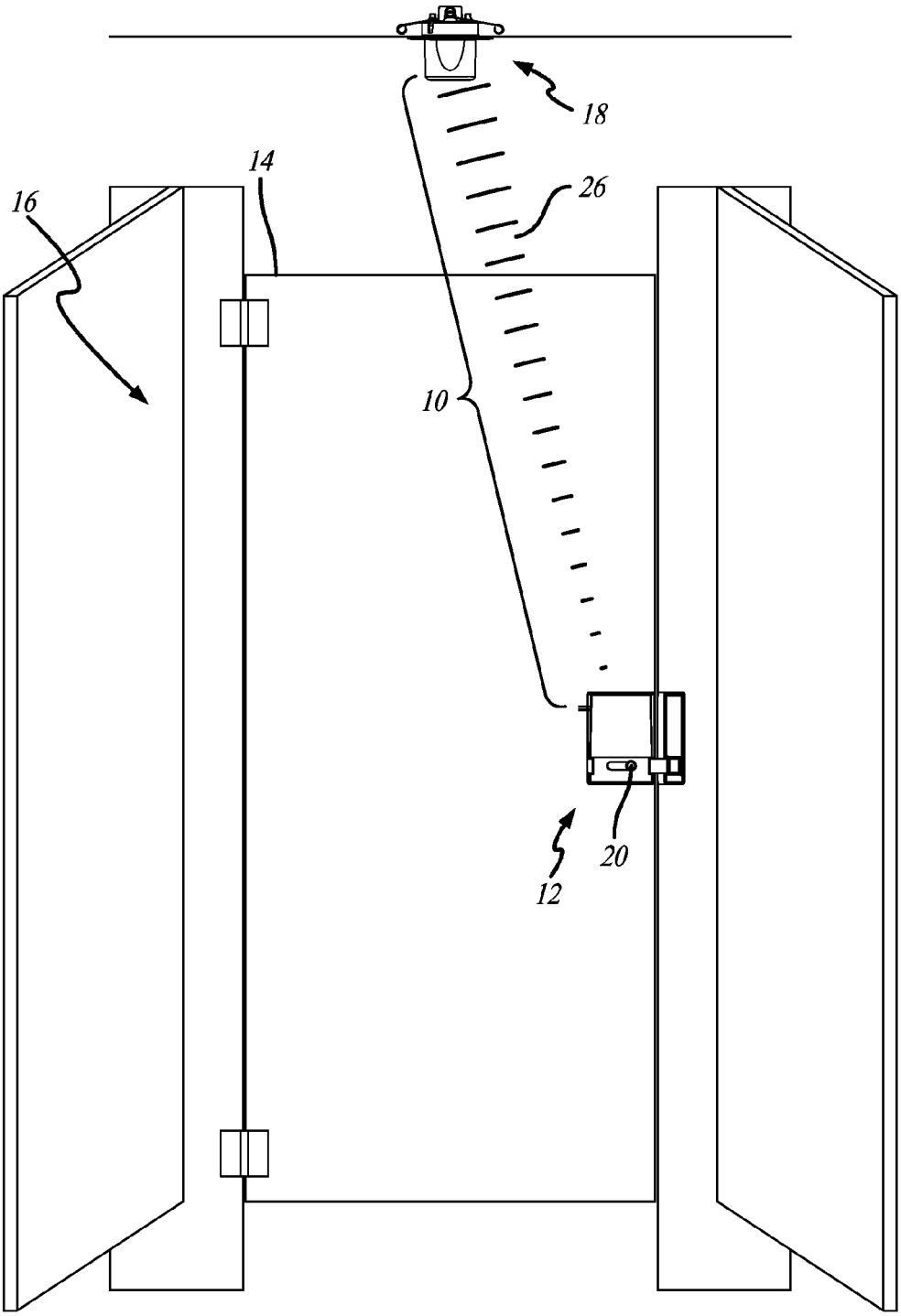
FIG. 1 is an environmental view of a preferred embodiment of a restroom occupancy stall indication system installed within a restroom stall.
Figure 2:
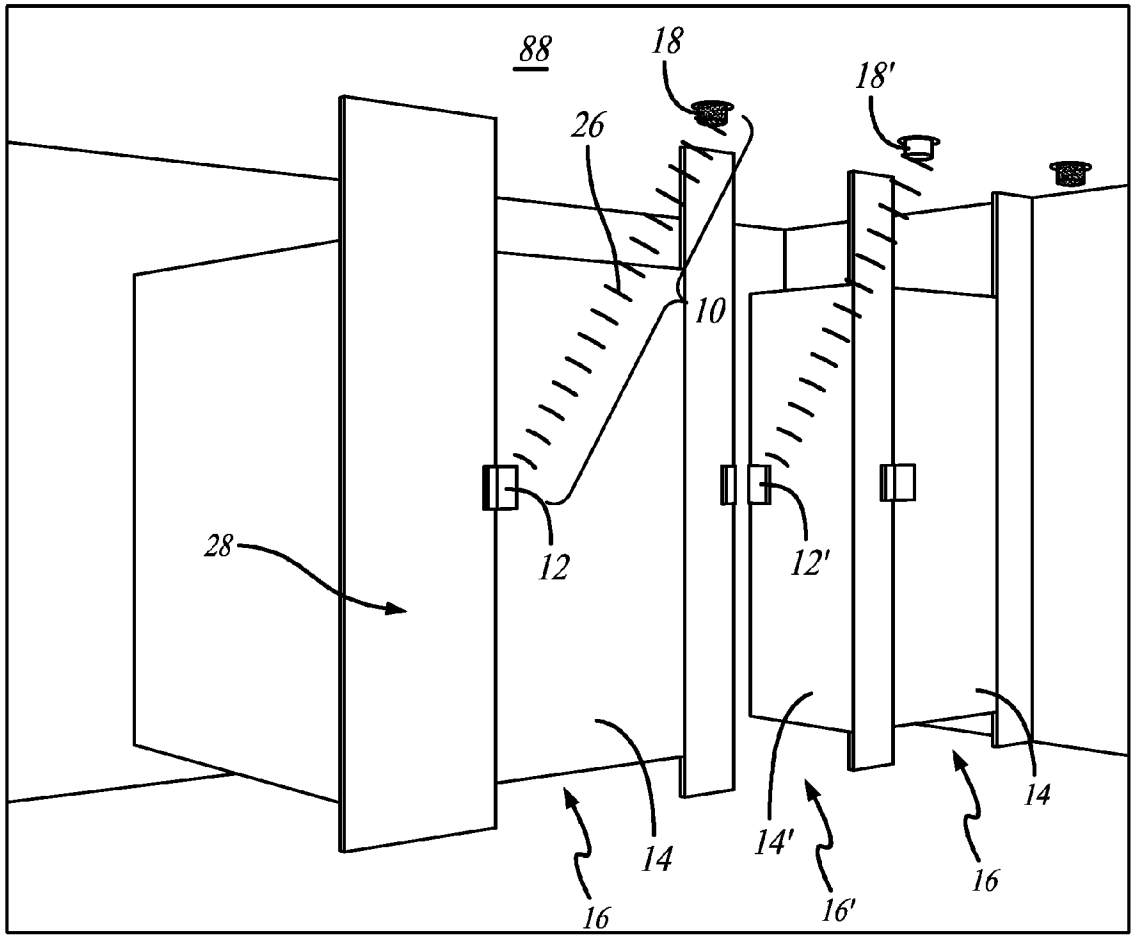
FIG. 2 is an environmental view of a multiple stall restroom wherein each stall includes a respective signal unit and an indicator light.

As shown in the drawings for the purposes of illustration, the present disclosure for a restroom stall occupancy indicator system is generally referred to by reference numeral 10 in FIGS. 1 and 2. In FIG. 1, the system 10 generally includes a signal unit 12 used for locking and unlocking a stall door 14 of a restroom stall 16. Furthermore, the system 10 also includes an indicator light 18 that provides visual identification regarding whether the stall door 14 is locked or unlocked. The signal unit 12 includes a slidable latch 20 that triggers an internal switch 22 (FIGS. 8-10) when moving between the locked and unlocked positions, as described in more detail below. The latch 20 may be constructed from any suitable material known in the art, such as stainless steel or plastic. A transmitter 24 in communication with the switch 22 emits a communication signal 26 indicating whether the latch 20 is in a locked or unlocked position. Preferably, the communication signal 26 is wireless and is emitted only after the latch 20 is moved from the locked position to an unlocked position, or vice versa. Although, a person of ordinary skill in the art will recognize that the transmitter 24 may continually communicate the status of the latch 20 (e.g., either in the locked or unlocked position) and may communicate via a wire signal, as opposed to a wireless signal. In this respect, the locked or unlocked state is communicated or received, as described in more detail below, by the indicator light 18. The indicator light 18 emits a light preferably corresponding to the occupancy status of the restroom stall 16. For example, a "red" light may indicate that the restroom stall 16 is occupied, whereby the latch 20 is in the locked position, and a "green" light may indicate that the restroom stall 16 is unoccupied, whereby the latch 20 is in the unlocked position. Of course, the restroom stall indication system 10 may use other colors (e.g., "blue" may indicate the need for service, such as maintenance or supplies) or light indicators (e.g., blinking or flashing) to indicate the occupancy or other status of the restroom stall 16.

In this respect, FIG. 2 illustrates a multi-stall restroom 28 wherein each of the restroom stalls 16 include at least one of the signal units 12 corresponding with at least one of the indicator lights 18. In one embodiment, each of the indicator lights 18 may receive a unique wireless communication signal 26 from respective transmitters 24 in each of the corresponding signal units 12. As shown in FIG. 2, a patron looking down the corridor of several restroom stalls 16 in the multi-stall restroom 28 can immediately identify that two of the three stalls 16 are occupied (indicated by the relatively "darker" light), while one stall 16' is unoccupied (indicated by the relatively "lighter" light). To this end, the patron does not need to look under the stall 16' or otherwise inspect the restroom 28 to find an open and unoccupied stall 16'.

Figure 3:
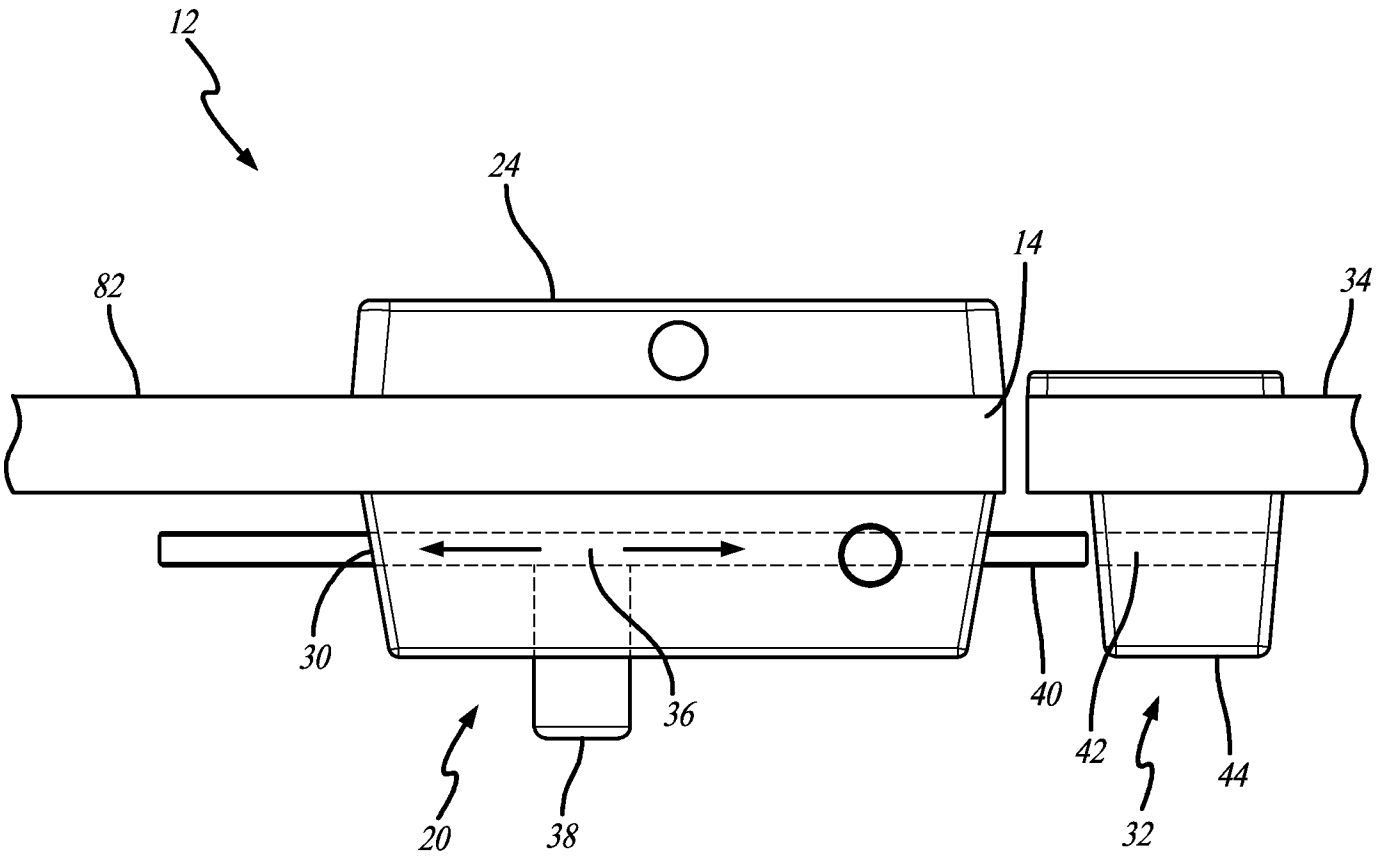
FIG. 3 is top view further illustrating the signal unit installed to a stall door, wherein a transmitter is mounted to an exterior wall of the stall door and a corresponding latch mechanism is mounted to an interior wall of the stall door.
Figure 4:
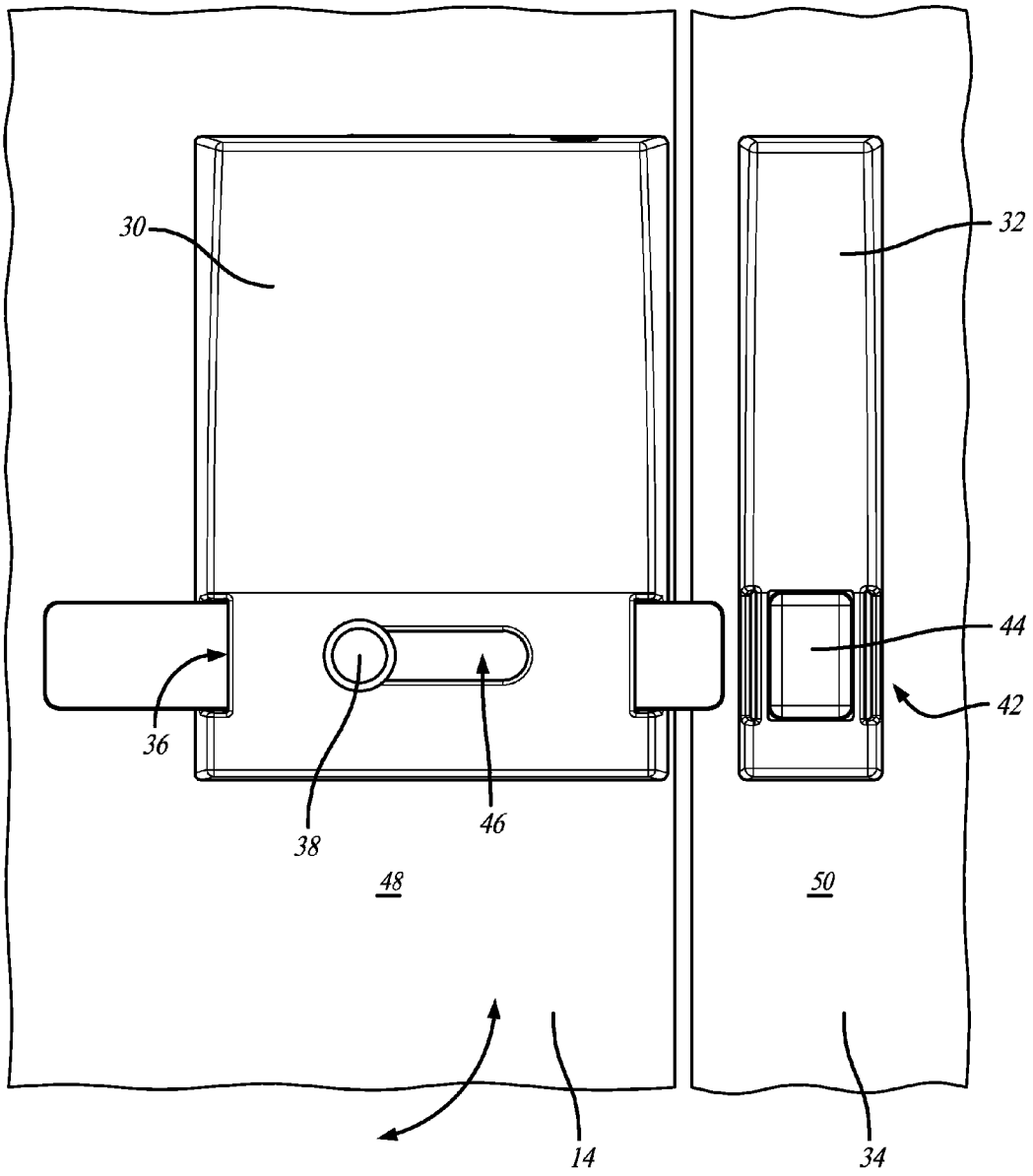
FIG. 4 is a front view of the latch mechanism in an unlocked position.
Figure 5:
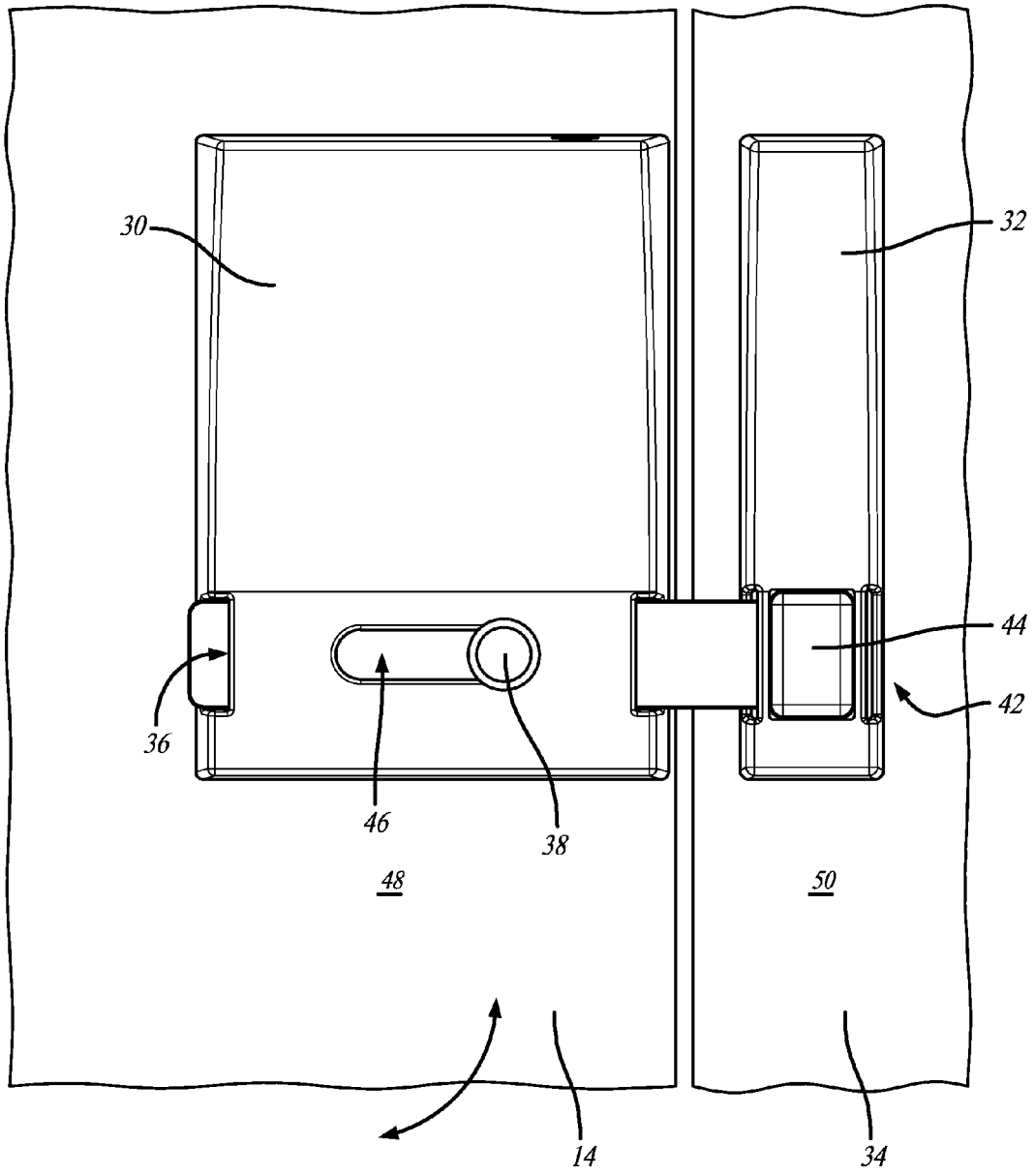
FIG. 5 is a front view of the latch mechanism similar to FIG. 4, in a locked position.

FIGS. 3-5 illustrate the outer structure and operation of the signal unit 12. In this respect, FIG. 3 is a top view of the signal unit 12 shown mounted to the stall door 14. In one embodiment, the signal unit 12 generally includes two sections, a first active portion 30 (i.e., the "smart" portion) mounted to the stall door 14 and retains the movable latch 20 in slidable relation to a second inactive portion 32 (i.e., the "dumb" portion) mounted to a stationary or fixed wall 34. The latch 20 generally resides within a slide chamber 36 for sliding movement therein between locked and unlocked positions. In this respect, a patron may hand manipulate an outwardly projecting knob 38 to slide an engagement end 40 between the disengaged or unlocked position shown in FIGS. 3 and 4, into slide-in engagement with a locking channel 42 formed from a protrusion 44 generally extending out from and toward the area defined by the restroom stall 16, as shown in FIG. 5. The active portion 30 may restrict maximum side-to-side movement of the latch 20 with a restrictor channel 46 as shown best in FIGS. 4 and 5. The locking channel 42 prevents outward movement of the engagement end 40 rigidly extending between the active portion 30 and the inactive portion 32, to prevent inward pivoting movement of the stall door 14 relative to the fixed wall 34. This effectively secures the restroom stall 16 in a locked or occupied position.

The embodiment shown in FIGS. 3-10 illustrates a manual latch 20 externally accessible and slidable through hand or manual manipulation of the knob 38. Although other locking mechanisms known in the art may be compatible with the restroom stall indication system 10 disclosed herein. For example, a solenoid or comparable actuator (not shown) may automatically slide the latch 20 to the locked position shown in FIG. 5 when a patron enters the restroom stall 16. In this embodiment, the patron may press a button or a motion sensor may detect that the stall is occupied, thereby locking the stall door 14 with the latch 20.

In the preferred embodiment illustrated in FIGS. 3-5, the active portion 30 mounts to an interior wall 48 of the stall door 14 and the inactive portion 32 mounts to an interior wall 50 of the fixed wall 34. Of course, the active portion 30 may mount to the interior wall 50 of the fixed wall 34 and the inactive portion 32 may mount to the interior wall 48 of the stall door 16. Alternatively, the signal unit 12 may include only the active portion 30. In this respect, the latch 20 may lock the stall door 14 by extending outwardly from the active portion 30 into a position adjacent the interior wall 50 to prevent outward pivoting movement of the stall door 14. As such, the latch 20 prevents the door 16 from opening outwardly. A magnet (not shown) may be mounted into the fixed wall 34 to selectively attract the engagement end 40 when the latch 20 is in the locked position shown in FIG. 5, to enhance closure of the stall door 14.

Figure 6:
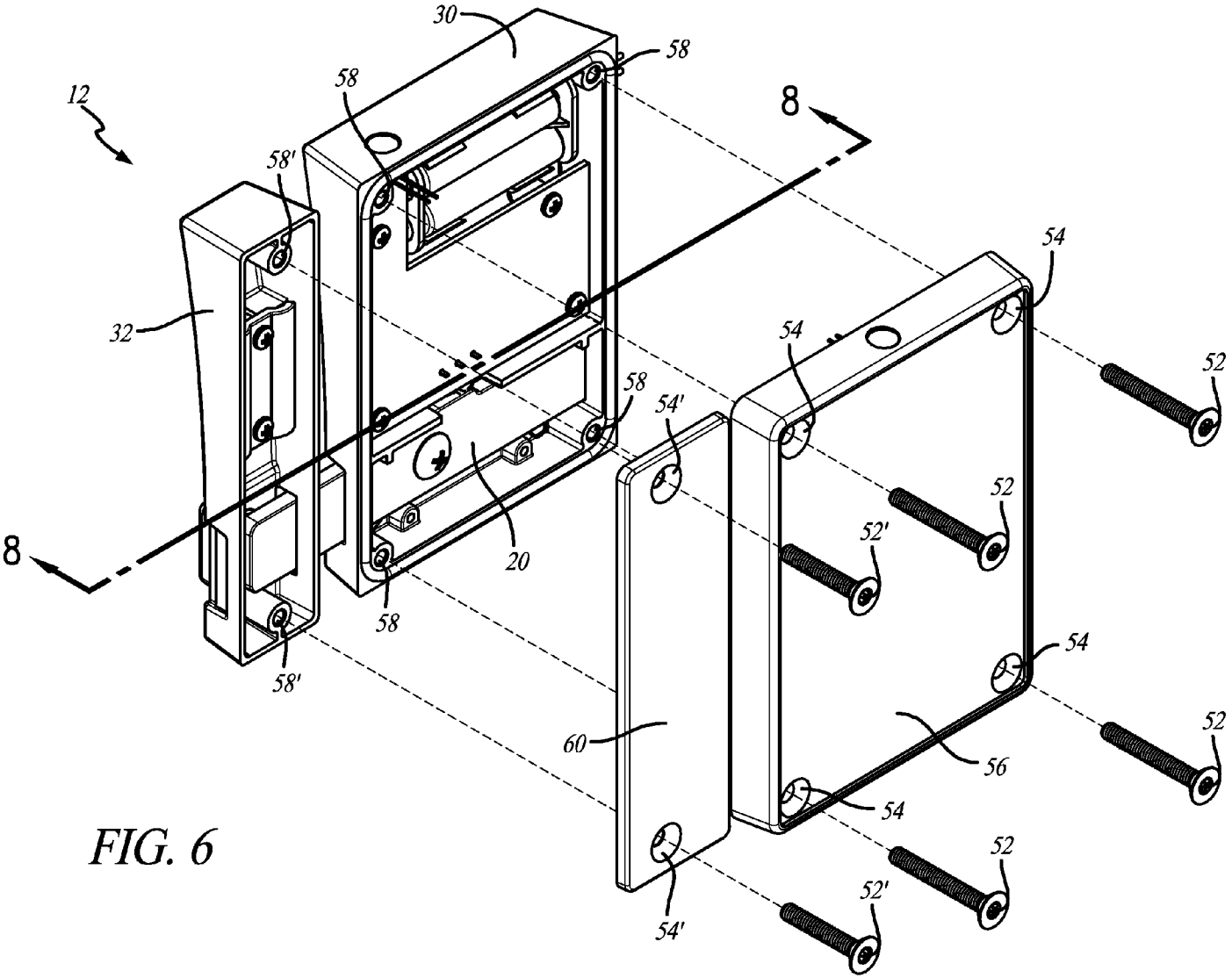
FIG. 6 is partial exploded rear perspective view illustrating the positioning of the transmitter relative to the latch mechanism in the absence of the restroom stall door.
Figure 7:
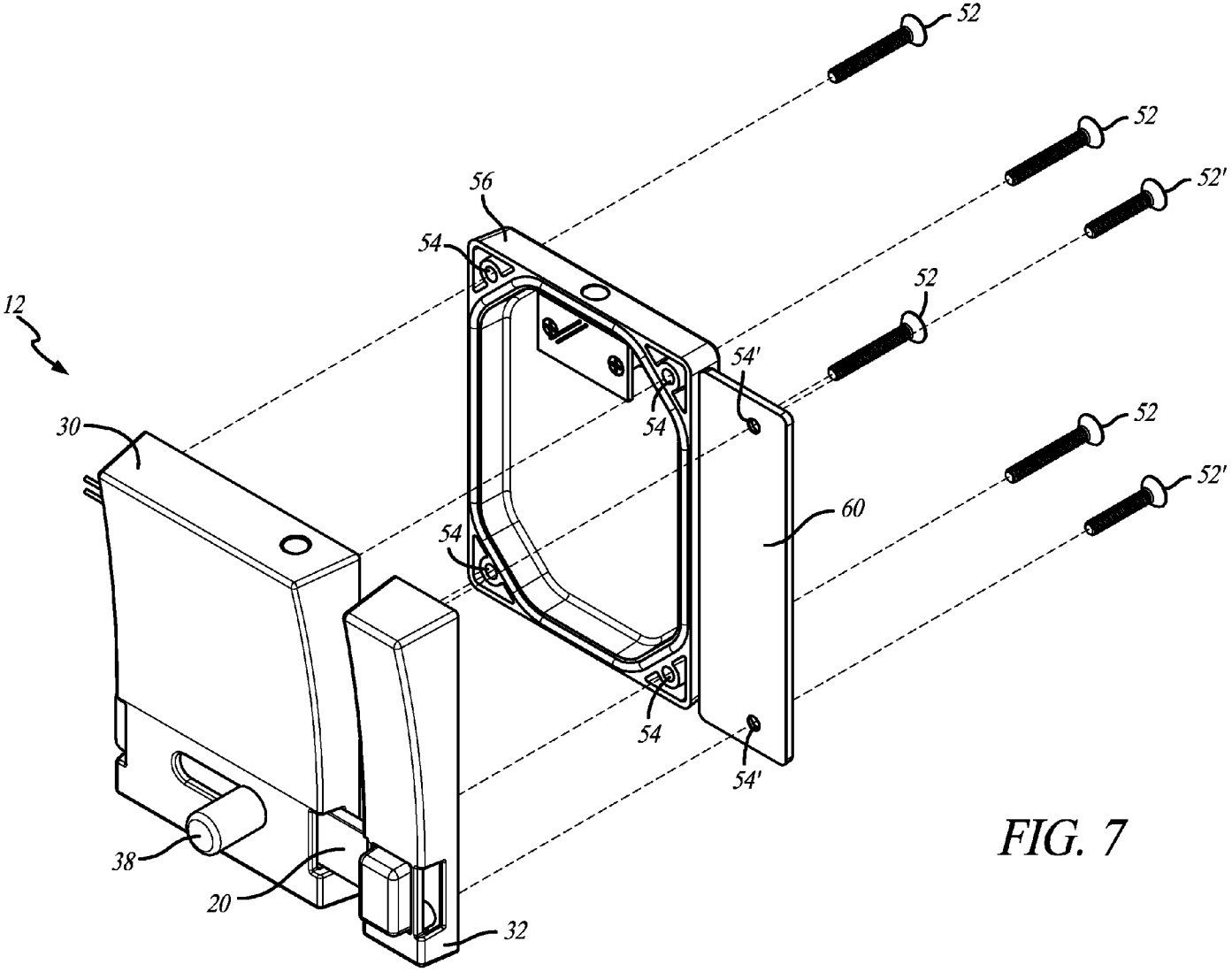
FIG. 7 is partial exploded front perspective view illustrating the positioning of the transmitter relative to the latch mechanism in the absence of the restroom stall door.

FIGS. 6 and 7 are partially exploded perspective views illustrating the latch 20 relative to the transmitter 24 in the absence of the stall door 14. As shown, a set of screws 52 are selectively insertable into a set of corresponding apertures 54 formed in an outer housing 56 of the transmitter 24. The screws 52 should be long enough to extend through the width of the transmitter 24, including the outer housing 56, through the width of the stall door 14, for screw-in reception in a corresponding set of receptacles 58 formed in the active portion 30. Similarly, a pair of screws 52' extend through a pair of corresponding apertures 54' for selected screw-in reception into a pair of corresponding receptacles 58' formed from the inactive portion 32. In this respect, the screws 52, 52' hold the transmitter 24 and related mounting bracket 60 in spaced relation relative to the active portion 30 and the inactive portion 32 with the stall door 14 and the fixed wall 34 respectively sandwiched in between.

Figure 8:
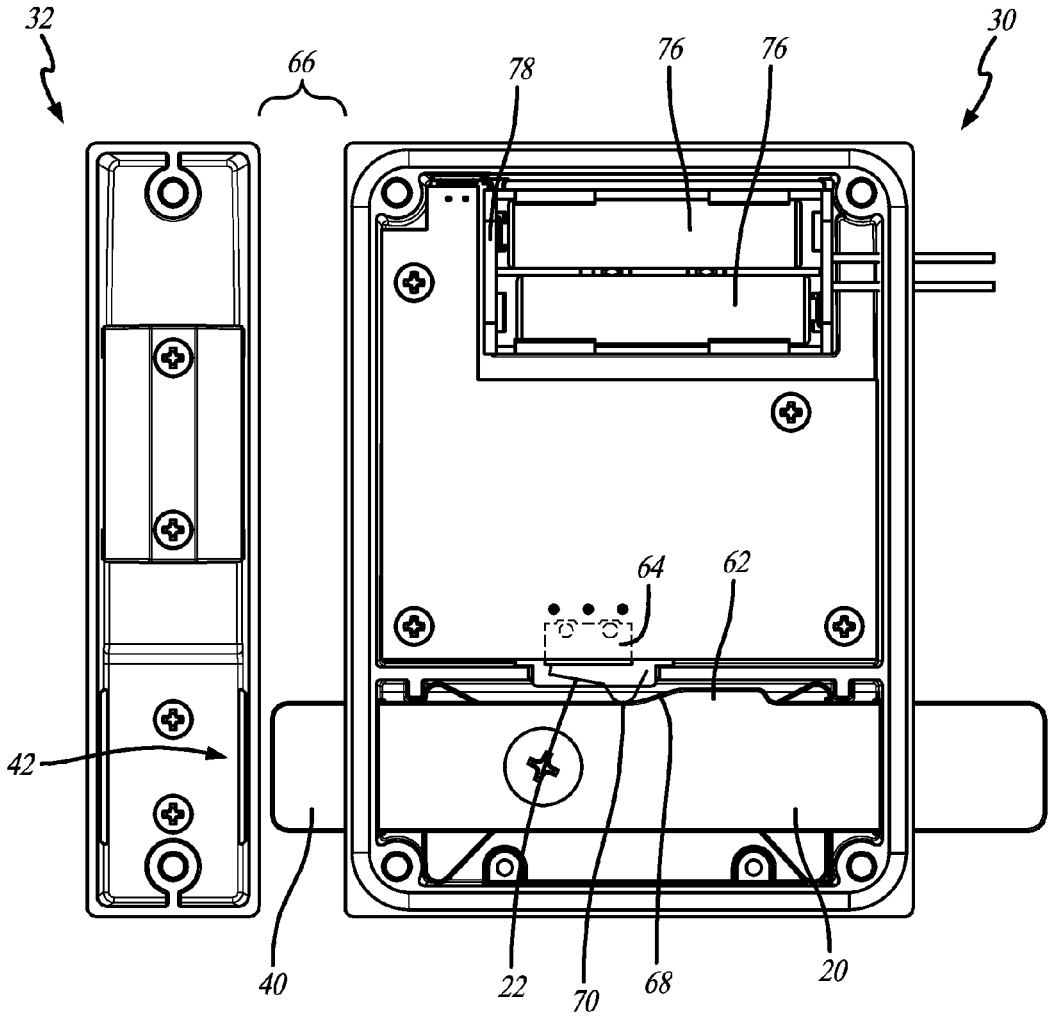
FIG. 8 is an interior view of the latch mechanism taken generally about the line 8-8 in FIG. 6, illustrating the latch disengaged from an internal switch when in the unlocked position.
Figure 9:
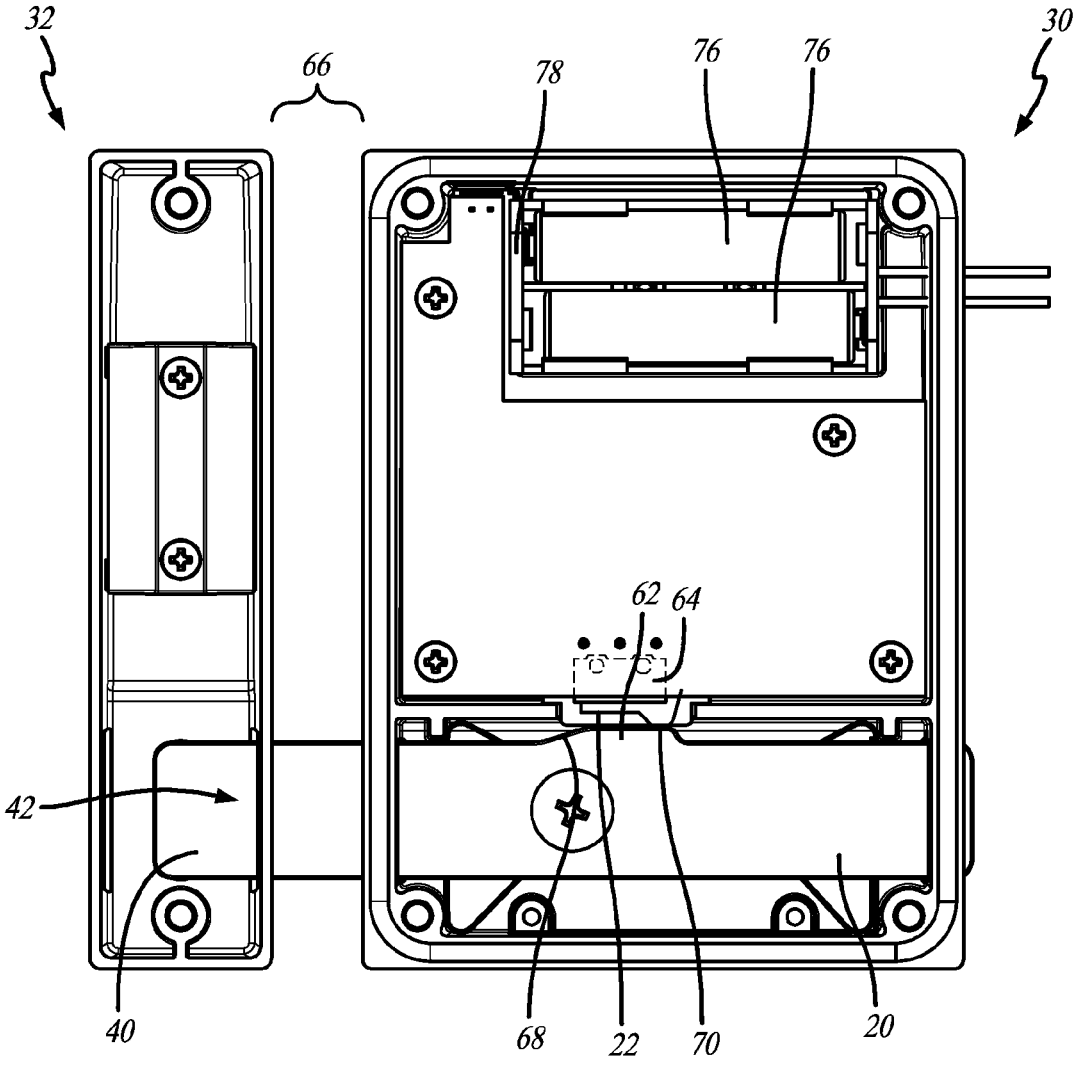
FIG. 9 is an interior view of the latch mechanism similar to FIG. 8, illustrating the latch depressing the internal switch when in the locked position.

Movement of the latch 20 from the unlocked position (FIG. 8) to the locked position (FIG. 9) causes movement or actuation of the switch 22 from a lower or inactive position (FIG. 8) to an upper or active position (FIG. 9). For example, FIG. 8 is an interior perspective view of the active portion 30 illustrating the retaining latch 20 in the unlocked position wherein the engagement end 40 is relatively flush with the housing of the active portion 30. In this respect, the engagement end 40 resides only within the slide chamber 36 and is otherwise disengaged out from within the locking channel 42 in the inactive portion 32 to permit the stall door 14 to pivot open. In this position, a cam 62 generally extending upwardly from a longitudinal section of the latch 20 is positioned behind the downwardly biased switch 22. The switch 22 is preferably downwardly spring-biased to the position generally shown in FIG. 8 so that the switch 22 is generally disengaged or otherwise not in electrical contact with a sensor 64 (FIG. 10).

Sliding movement of the latch 20 causes the engagement end 40 to extend out from the active portion 30, bridge a gap 66 between the active portion 30 and the inactive portion 32, which otherwise permits clearance to swing the stall door 14 between open and closed positions, for slide-in reception into the locking channel 42 in the inactive portion 32. As such, in this position, the body of the engagement end 40 resides firmly within the locking channel 42 to prevent pivoting movement of the stall door 14. Although, more importantly, in this position, as shown in FIG. 9, the cam 62 moves into engagement with the switch 22 to generally bias the switch 22 upwardly into an engagement or active position. The cam 62 preferably includes a slope or ramp 68 to help facilitate the upward movement, and may be biased generally against a relatively curved portion 70 of the switch 22.

Figure 10:
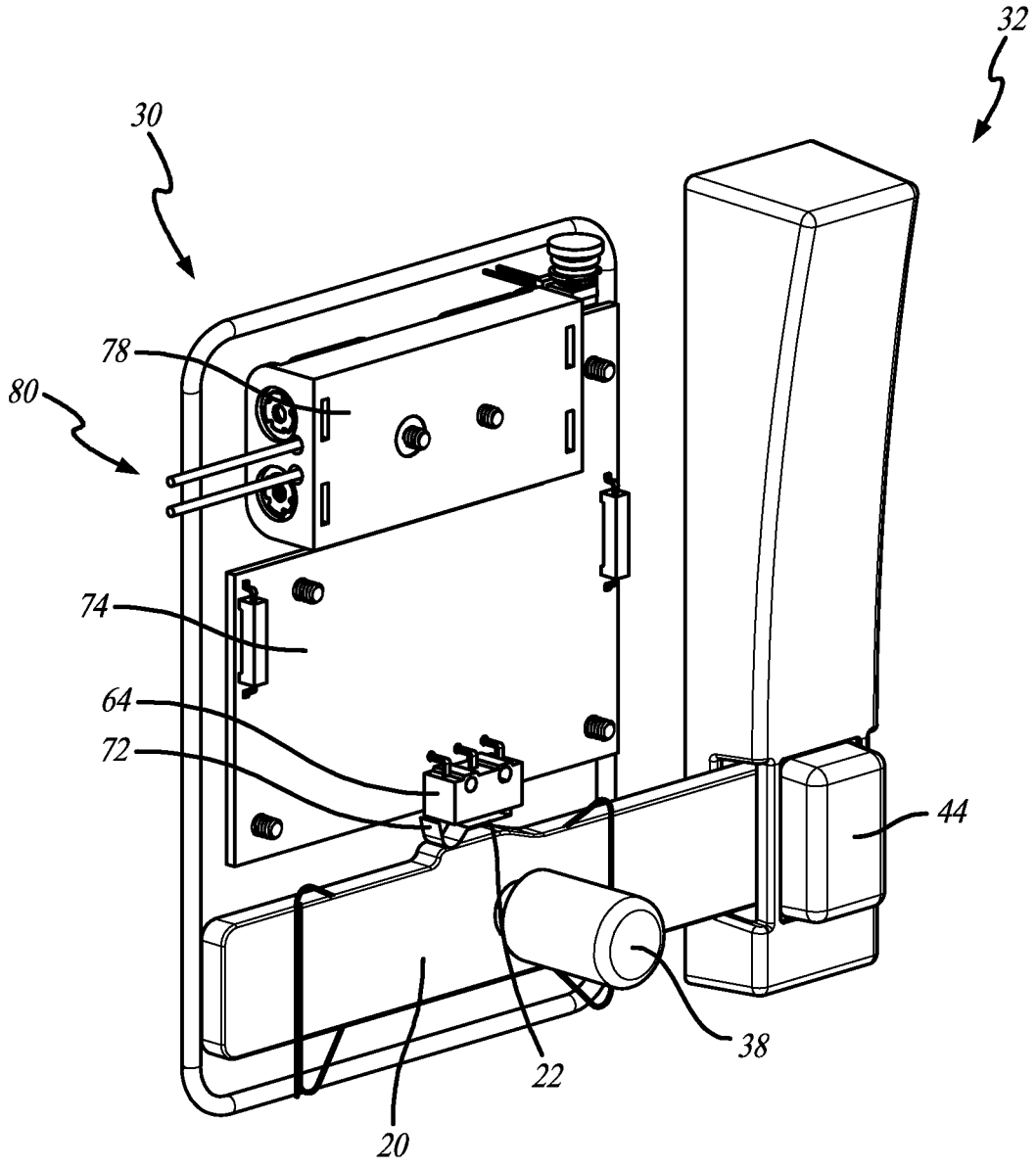
FIG. 10 is a perspective view of the latch mechanism without a front panel, further illustrating electrical connection of the switch with a sensor.

FIG. 10 is a perspective front view of the active portion 30 similar to FIGS. 4 and 5 with the front cover removed to expose the inner circuitry. More specifically, FIG. 10 illustrates the switch 22 upwardly positioned into the aforementioned active position wherein an engagement arm 72 is in active contact with the sensor 64. Here, the engagement arm 72 (or another portion of the switch 22) may complete an electrical connection within the sensor 64 that causes transmission of electrical current from the sensor 64 to a control circuit 74. The switch may also trip a proximity sensor (not shown) in the sensor 64 as a result of such pivoting movement, as opposed to completing an electrical connection. The control circuit 74 may be powered by a pair of batteries 76 or by a wire-line connection 80 coupled to a hardwired power source (not shown) such as an alternating current (AC) or direct current (DC) power source. The batteries 76 are preferably either AA or AAA batteries, but may also be other types of batteries, such "A" or 9-Volt batteries. The sensor 64 relays a signal to the control circuit 74 that the latch 20 is in the locked position. The control circuit 74 then relays the locked state to the transmitter 24 mounted to a front surface 82 (FIG. 3) of the stall door 14 for wireless transmission (e.g., via the communication signals 26, 26') to a receiver 84 within the corresponding indicator light 18 or to a communications hub 86.

In one embodiment, the transmitter 24 may send two different types of signals: a first occupied signal when the switch 22 is depressed into engagement with the sensor 64, thereby indicating the stall 16 is occupied; and a second unoccupied signal when the switch 22 is extended out from or otherwise disengaged from the sensor 64, thereby indicating that the stall 16 is unoccupied. Preferably, the absence of a signal does not indicate that the latch 20 is either locked or unlocked, as a way to save energy. Of course, the switch 22 may be any switch known in the art capable of identifying movement of the latch 20 or otherwise identifying when the signal unit 12 is in a locked position or an unlocked position.

The transmitter 24 preferably communications with the receiver 84 or the communication hub 86 wirelessly and digitally, and more preferably via an infrared signal (e.g., an infrared data-link). In this respect, the transmitter 24 preferably mounts to the front surface 82 of the stall door 14 as best illustrated in FIG. 3, thereby creating an unobstructed line-of-sight path for the infrared signal 26, 26' to the receiver 84 or the communication hub 86. It is preferred to position the transmitter 24 so that it has an unobstructed line-of-sight path to the receiver 84 and/or the communication hub 86 so the stall door 14 does not block or impede the infrared signal. This can save on energy costs because the transmitter 24 may require less energy to communicate directly with the receiver 84 and/or the communication hub 86. Furthermore, the communication signal 26, 26' may be bilateral. That is, the transmitter 24 may be configured to transmit communication signals and/or receive communication signals to and/or from the receiver 84 and/or the communication hub 86. The same is true for the receiver 84 and/or the communication hub 86, i.e., the receiver 84 and/or the communication hub 86 may be able to send and/or receive communication signals for bilateral communication with each other or with the transmitter 24.

Figure 11:
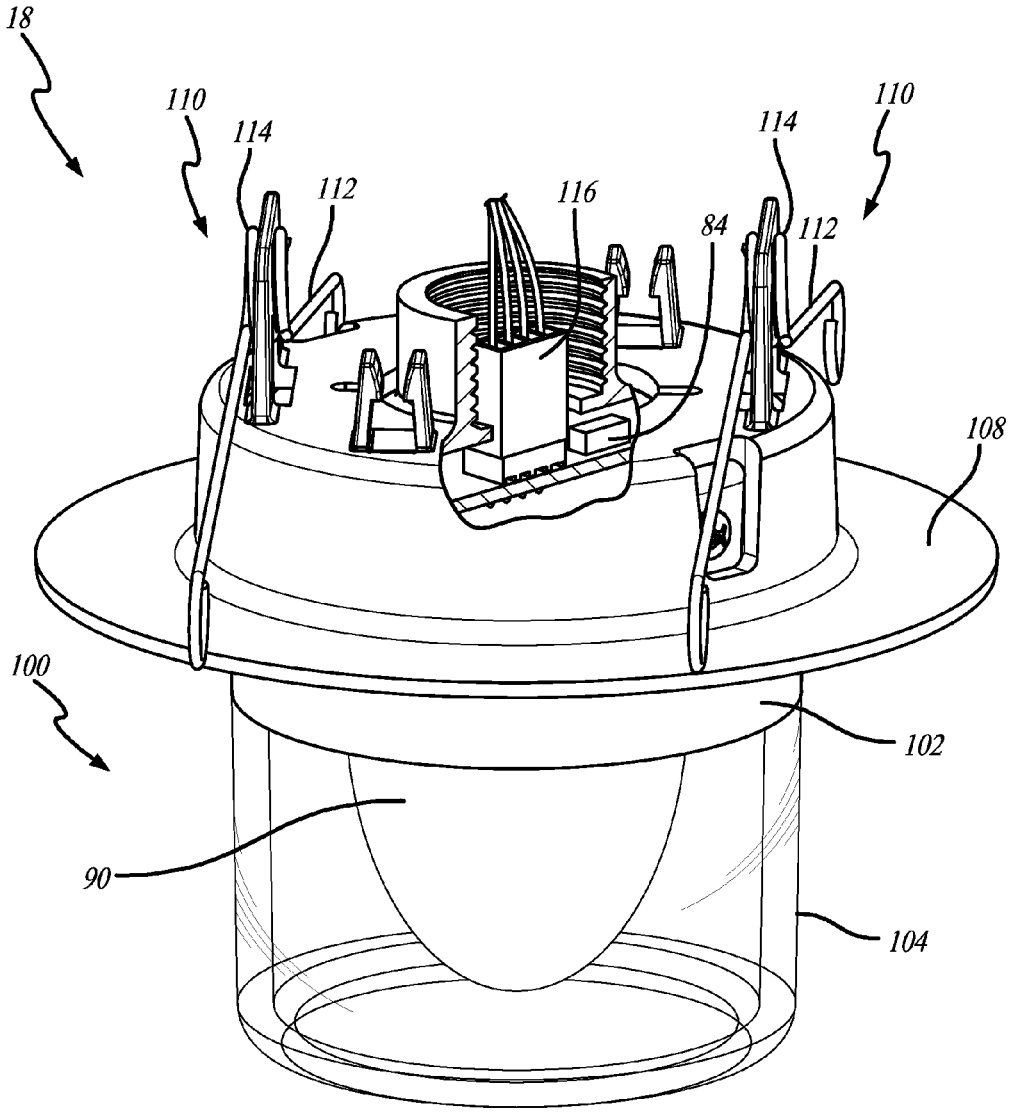
FIG. 11 is a partial cut-away perspective view of one embodiment of the indicator light for use with the restroom stall indicator system disclosed herein.

As mentioned above, the indicator light 18 provides visual notification regarding the occupancy status of the restroom stall 16 in response to the communication signals 26, 26' generated by the transmitter 24 and received by either the receiver 84 or the communication hub 86. An exemplary indicator light 18 is shown in FIG. 11. The receiver 84 is preferably disposed within the indicator light 18, thereby creating a single unit for easy installation on a ceiling 88 in, e.g., the multi-stall restroom 28 shown in FIG. 2. As such, the indicator light 18 may be semi-recessed if the ceiling can accommodate an inset device (e.g., drywall) or pendant-mounted if the ceiling prohibits semi-recessed mounting (e.g., a concrete ceiling). The indicator light 18 preferably includes an indicator light bulb 90, such as a light emitting diode ("LED"). Although, the indicator light bulb 90 may be any type of light emitting device known in the art (e.g., incandescent, halogen, etc.). For example, the indicator light bulb 90 may emit a green or blue light when the corresponding restroom stall 16 is vacant, and may emit a red light when the restroom stall 16 is occupied. Although, any color may correspond to either the vacant or occupied statuses. Moreover, the indicator light 18 may be positioned in other locations relative to the respective restroom 16, such as on the floor or extending out from the stall door 14 or the fixed wall 34. Although, floor or ceiling mounted indicator lights are preferred to provide better visibility. In alternate embodiments, the indicator light 18 may be a single-colored light that illuminates only when the stall 16 is vacant (e.g., a green light), or the indicator light 18 may convey a message or advertisement when a stall is empty.

Figure 12:
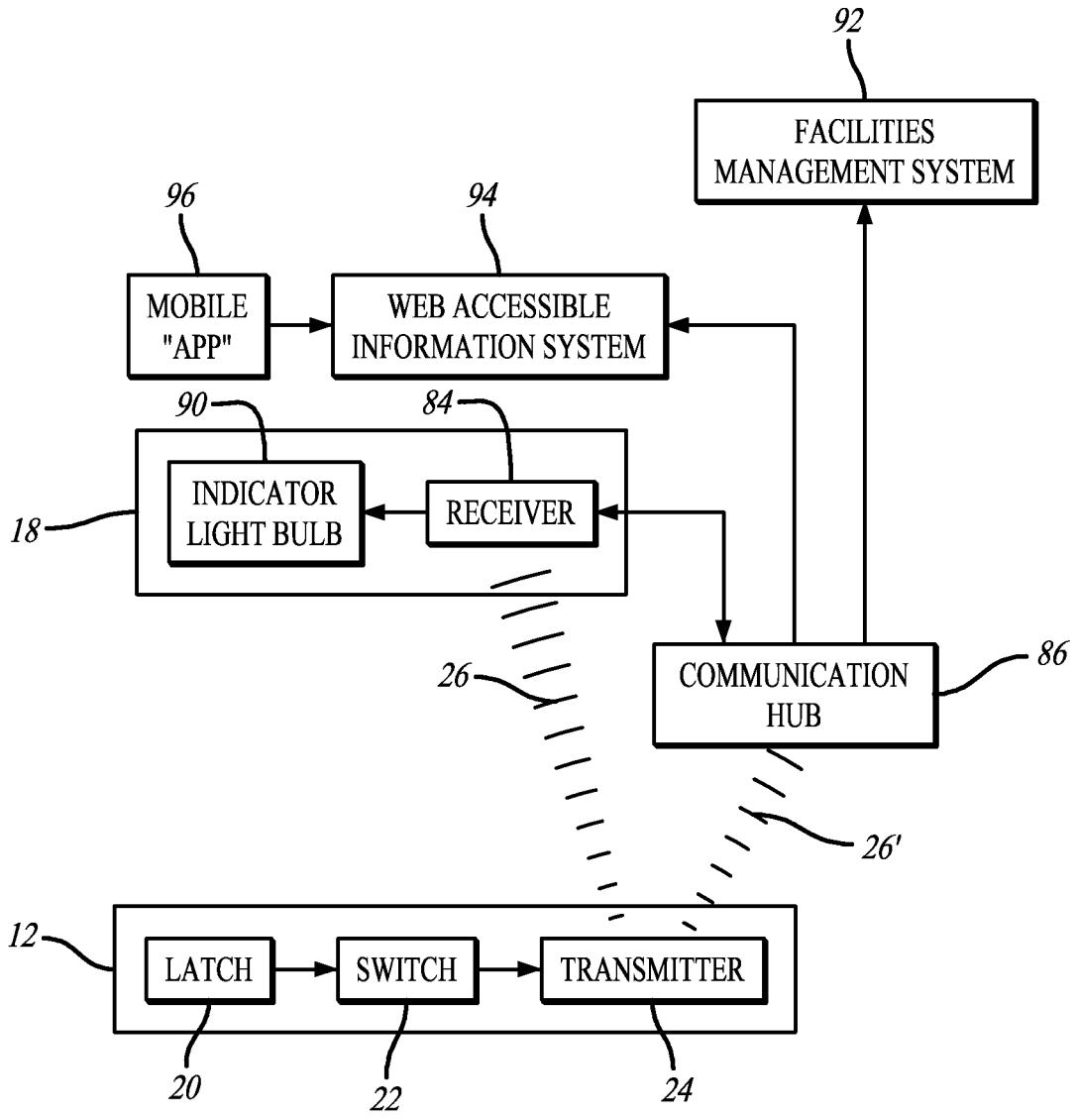
FIG. 12 is a schematic view of one embodiment illustrating communication of the indicator light and the signal unit with each other, or with a communication hub.
Figure 13:
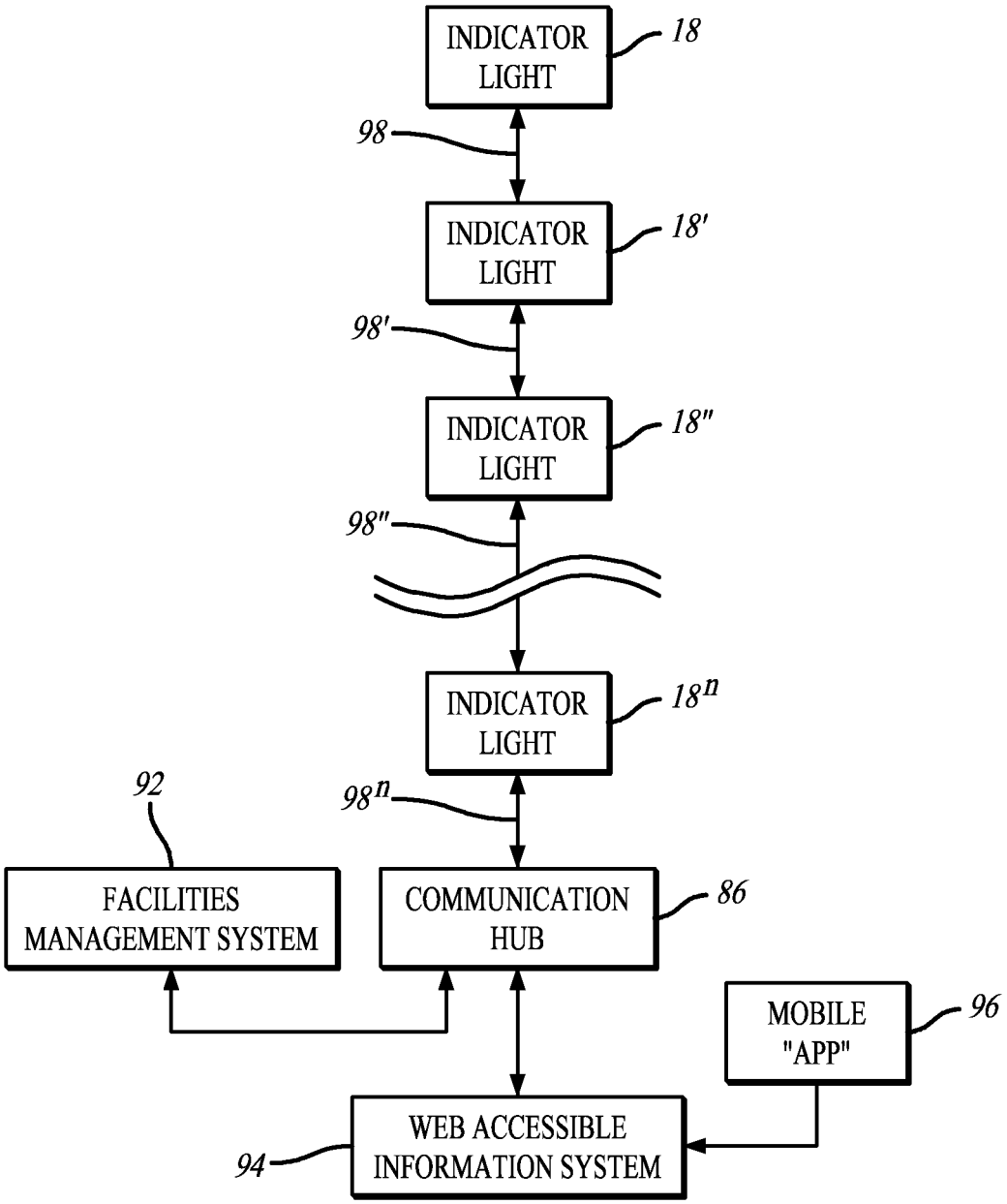
FIG. 13 is an alternate embodiment illustrating serial communication of multiple indicator lights with the communication hub.

As briefly mentioned above, the restroom stall indication system 10 may include the communication hub 86 for communicating with each of the indicator lights 18 in the multi-stall restroom 28 and/or each of the signal units 12 by way of respective transmitters 24. In one embodiment, the communication hub 86 may receive the occupancy status of each of the restroom stalls 16 from each of the indicator lights 18. In this embodiment, each of the transmitters 24 communicates directly with the respective receivers 84 in the indicator lights 18. The indicator light bulb 90 emits or otherwise changes color accordingly, and the status of the light bulb 90 is relayed to the communication hub 86, as generally schematically illustrated in FIG. 12. The communication hub 86 may communicate stall status information a facilities management system 92 or to a web accessible information system 94 accessible by patrons via a mobile "app" 96. In one embodiment, the indicator lights 18 are connected serially (i.e., "daisy-chained") to the communication hub 86 using low voltage communication connections such as Ethernet over power. In a particularly preferred embodiment, as illustrated in FIG. 13, each of the indicator lights 18-18" may be coupled to one another, and the communication hub 86, via respective low voltage wire connections 98-98". In this embodiment, each of the indicator lights 18-18" can communicate with the communication hub 86 through a single daisy-chain connection by way of the low voltage wire connections 98-98". Although, the indicator lights 18 may connect to the communication hub 86 in parallel, or may connect wirelessly, as briefly mentioned above. In an alternate embodiment, the transmitters 24 may communicate directly with the communication hub 86, which then communicates with the indicator lights 18. The communication hub 86 may be a central computer system server or a network.

As mentioned above and illustrated in FIG. 13, the communication hub 86 may communicate the facilities management system 92. As such, facilities maintenance personnel may have real-time access to restroom usage data such as the number patrons using the restroom. For example, maintenance staff may increase or decrease cleaning and maintenance cycles (e.g., refilling paper towels) based on past, current or real-time usage statistics. Maintenance staff may be able to determine that a particular stall or fixture therein needs repair if that stall is seldom used in a relatively heavily trafficked restroom. Moreover, maintenance staff may be able to determine if a battery in one of the signal units 12 or in one of the indicator lights 18 need replacing. In this respect, the system 10 provides maintenance personnel with real-time information regarding the state of the restroom without the need for a physical inspection, thereby reducing maintenance costs and wait times. Furthermore, the system 10 may include one or more signs (not shown) that display the wait times associated with the various restrooms in a venue to direct patrons to the restroom with the shortest wait time.

To this end, the communication hub 86 may communicate such real-time restroom information to the web accessible information system 94 for access by patrons through the mobile app 96 or the like. In this respect, patrons can obtain real-time restroom usage information, occupancy status and wait times associated with each restroom at a particular venue. Patrons can determine which restroom has the most vacant stalls or the shortest wait time without having to visually inspect each restroom or line. As such, patrons can go directly to the restroom with the shortest wait time. In this respect, the distribution of patrons across different restrooms at a single venue will be more efficiently spread out because the mobile application 96 can guide patrons to the shortest lines, if any. Ideally, communicating real-time restroom data from the communication hub 86 to the web accessible information system 94 should substantially eliminate problems associated with over loading of some restrooms, while leaving other restrooms substantially empty. Preferably, the mobile application 96 integrates with other applications related to the venue; although, the mobile application 96 may be a stand-alone program.

In one embodiment of the system 10, the signal unit 12 serves as a "universal retrofit kit". In this respect, the signal unit 12 fits over and replaces existing locks and latches currently found in restroom stalls. As such, the signal unit 12 and the transmitter 24 are distinct components that sandwich the stall door 14 so the transmitter 24 remains in direct line-of-sight with the receiver 84. Preferably, the signal unit 12 connects to the transmitter 24 via a wired connection (not shown) disposed in the space between the stall door 14 and the fixed wall 34.

In another aspect of the restroom stall indication system 10, the signal unit 12, and particularly the latch 20, should be compliant with the standards set forth in Sections 404.2.7 and 604.8.1.2 of the Americans with Disabilities Act (ADA) for all Accessible and Ambulatory stalls. Furthermore, the system 10 should be water-resistant to facilitate durability and reliability given the pervasive presence of water in restroom. Moreover, the system 10 is preferably tamper-resistant to ensure patron privacy.

Further with respect to the indicator light 18 illustrated in FIG. 11, the indicator light 18 preferably includes a lamp unit 100 housing the light bulb 90, which may be received therein in a light socket 102. Preferably, the lamp unit also 100 includes an enclosure 104 to provide protection for the light bulb 90. One or more screws secure the lamp 100 to a mounting plate 108, which may mount the indicator light 18 to the ceiling 88. Although, any suitable fastener may be used. Preferably, a pair of clips 110 secure the mounting plate 108 to the ceiling 88. In one embodiment, the clips 110 include a pair of arms 112 extending from a central torsion spring 114, which radially biases each of the arms 112 away from other. Each arm 112 rotates toward the other against the bias of the torsion spring 114 when inserted into the ceiling 88. Once disposed within the ceiling 88, the torsion spring 114 rotates each arm 112 away from the other, thereby suspending the indicator light 18 from the ceiling 88. That is, the clips 112 bend downwardly to facilitate insertion, and then extend outwardly into the ceiling receptacle to prevent the indicator light 18 from detaching from the ceiling 88. In this respect, the indicator light 18 is preferably semi-recessed in the ceiling 88. This mounting configuration is preferable when the ceiling can accommodate an inset device (e.g., a drywall ceiling), but the mounting configuration may also be usable with a pendant-mount if the ceiling prohibits semi-recessed mounting (e.g., a concrete ceiling).

In an alternative embodiment, the indicator lamp 18 may include a power line communication connection 116 (in addition or substitution of the receiver 84) such as one for Ethernet over power. In this respect, power line communication simultaneously powers the indicator light 18 (e.g., the receiver 84 and the light bulb 90) while allowing the receiver 84 to communicate with the communication hub 86. That is, electric current is used to power the indicator light 18 and to communicate data (e.g., the occupancy status of the corresponding stall 16) from the receiver 84 to the communication hub 86. As such, power line communication may reduce the complexity of the installation process (e.g., requiring only a single electrical connection, as opposed to two —one for power and one for data). Although, the indicator light 18 may use separate lines for powering the components thereof and communicating with the communication hub 84. Alternately, the receiver 84 and the light bulb 90 may be powered by batteries (e.g., AA or AAA batteries).

Figure 14:
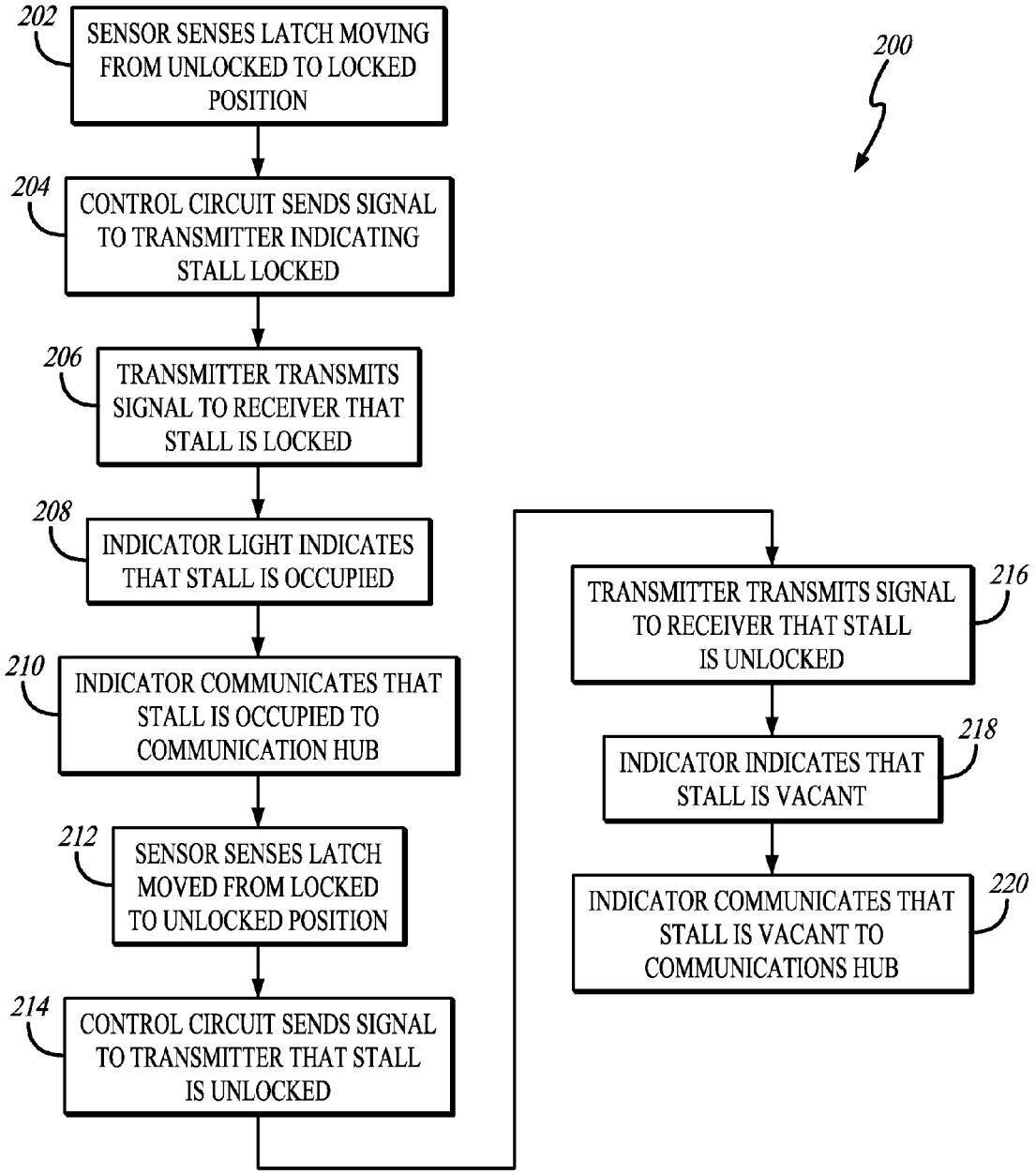
FIG. 14 is a flow chart illustrating a preferred method for providing an indication of the occupancy status of a restroom stall, in accordance with the embodiments disclosed herein.

FIG. 14 illustrates a preferred method (200) for indicating the occupancy status of the restroom stall 16 in accordance with the embodiments disclosed herein. In this respect, the first step (202) is for the sensor 64 to sense the latch 20 moving from the unlocked to the locked position. The sensor 64 senses this change in the position of the latch 20 when, e.g., the cam 62 repositions the switch 22 to being engaged with the sensor 64 (as discussed in greater detail above). The next step (204) is for the control circuit 74 to relay the locked status to the transmitter 24, indicating that the restroom stall 16 is now locked. In step (206), the transmitter 24 transmits the communication signal 26 to the receiver 84, indicating that the stall 16 is now locked. As mentioned above, this signal is preferably wireless and, more preferably, infrared. The transmitter 24 may also send the communication signal 26 to the communication hub 86. In response, the indicator light 18 preferably changes color to signal that the stall 16 is occupied (208) by, e.g., illuminating a green light. Next, the indicator light 18 communicates that the stall 16 is occupied to the communication hub 86 in step (210). Then, when the occupant of the restroom stall 14 exits, the sensor 64 senses the latch 20 move from the locked to the unlocked position by way of disengagement of the switch 22 from movement of the cam 62, as discussed above. The control circuit 74 relays the change in position to the transmitter 24, indicating that the stall 16 is now unlocked (214). In step (216), the transmitter 24 transmits another communication signal 26 to the receiver 84 that the stall 16 is unlocked. The indicator light 18 changes color to signal that the stall 16 is vacant (218) by, e.g., illuminating a green light. Next, the indicator light 18 communicates that the stall 16 is vacant to the communication hub 86, as part of step (210). As such, patrons waiting in line may easily discern that the restroom stall 16 was initially occupied, then became vacant when the patron unlocked the stall door 14 and left, by way of the visual identification provided by the indicator light 18.

Although several embodiments have been described in detail for purposes of illustration, various modifications may be made without departing from the scope and spirit of the invention. Accordingly, the invention is not to be limited, except as by the appended claims.

What is claimed is:

1. A restroom stall occupancy indicator system, comprising:

a latch movable between a locked position and an unlocked position;

a sensor responsive to selected positioning of the latch in the locked position or in the unlocked position, wherein a cam selectively pivots a switch into engagement with the sensor when the latch moves into the locked position, and permits selective pivotal disengagement of the switch from the sensor when the latch moves into the unlocked position;

a transmitter in communication with the sensor for relaying a communication signal indicating that the latch is in the locked position or in the unlocked position;

a receiver in communication with the transmitter for receiving the communication signal; and an indicator coupled with the receiver and responsive to the communication signal to provide a first visual identification when the latch is in the unlocked position and a second visual identification when the latch is in the locked position.

2. The system of claim 1, wherein the latch includes an externally accessible knob for manual movement between the locked position and the unlocked position.

3. The system of claim 1, wherein the latch selectively mounts to an interior surface of a stall door and the transmitter selectively mounts to an exterior surface of the stall door.

4. The system of claim 3, wherein the latch and the transmitter selectively sandwich the stall door therebetween.

5. The system of claim 1, wherein the communication signal comprises a first occupied signal when the latch is in the locked position and a second unoccupied signal when the latch is in the unlocked position.

6. The system of claim 1, wherein the communication signal comprises a wireless communication signal.

7. The system of claim 6, wherein the wireless communication signal comprises an infrared signal.

8. The system of claim 1, wherein the first visual identification comprises a light comprising a first color and the second visual identification comprises a light comprising a second color.

9. The system of claim 1, wherein the indicator selectively mounts to a restroom ceiling remote from the latch.

10. The system of claim 1, further including a communication hub in communication with the receiver.

11. The system of claim 1, wherein the latch includes a battery power source or a hardwire power source.

12. The system of claim 1, wherein the indicator comprises multiple indicator lights coupled to one another in a daisy-chain.

13. The system of claim 1, wherein the latch includes an active portion housing the switch and the sensor and an inactive portion configured for slide in reception of the latch to retain a restroom door in the locked position.

14. A system for providing occupancy status for a multi-stall restroom, comprising:

a signal unit associated with each stall in the multi-stall restroom, each signal unit being movable between a locked position and an unlocked position;

a sensor associated with each signal unit, wherein each sensor is responsive to selected positioning of the respective signal unit between the locked and unlocked positions, wherein a cam selectively pivots a switch into engagement with the sensor when the signal unit moves into the locked position, and permits selective pivotal disengagement of the switch from the sensor when the latch moves into the unlocked position;

a transmitter in communication with each sensor for relaying a respective communication signal indicating that the respective signal unit is either in the locked position or in the unlocked position;

a remote indicator associated with each signal unit and responsive to the respective communication signal for providing a first visual identification when the respective signal unit is in the unlocked position and a second visual identification when the signal unit is in the locked position; and a communication hub providing real-time occupancy data for the multi-stall restroom based on the locked or unlocked position of each of the signal units associated with each stall.

15. The system of claim 14, including a receiver coupled with each remote indicator for receiving the communication signal from the transmitter.

16. The system of claim 14, wherein the communication hub includes a wireless transmitter and a wireless receiver for communication with the signal unit and the remote indicator.

17. The system of claim 14, wherein the communication signal comprises an infrared signal.

18. The system of claim 14, wherein the remote indicator includes a ceiling mountable bracket.

19. The system of claim 14, wherein the first visual identification comprises a first-colored light and the second visual identification comprises a second colored-light.

20. The system of claim 14, wherein the communication hub comprises a central server.

21. The system of claim 14, including a facilities management system in real-time communication with the communication hub to provide real-time usage information for the multi-stall restroom.

22. The system of claim 14, wherein each signal unit includes an externally accessible latch for manual movement between the locked position and the unlocked position.

23. The system of claim 22, wherein the latch selectively mounts to an interior surface of a stall door and the transmitter selectively mounts to an exterior surface of the stall door, the latch and the transmitter selectively sandwich the stall door therebetween.

* * * * *